United States Patent [19]

Gonsalves

[11] 4,223,932

[45] Sep. 23, 1980

[54] MECHANIC'S LIFTING DEVICE

[76] Inventor: Almiro Gonsalves, 660 Garside Ct., San Leandro, Calif. 94579

[21] Appl. No.: 973,880

[22] Filed: Dec. 28, 1978

[51] Int. Cl.[3] ..... B66C 1/10

[52] U.S. Cl. ..... 294/1 R; 16/114 R; 85/1 R; 403/3; 403/174

[58] Field of Search ..... 294/1 R, 2, 15, 78 R, 294/78A, 82 R, 82 AH, 83 R, 86 R; 16/114 R, 124–127; 24/225, 230.5 R; 29/264, 281; 85/1 R, 1 H; 403/3, 170, 174, 178

[56] References Cited

U.S. PATENT DOCUMENTS

| | | | |
|---|---|---|---|
| 1,437,252 | 11/1922 | Kinnaird | 294/1 R X |
| 1,529,518 | 3/1925 | Voeller | 294/15 |
| 1,532,898 | 4/1925 | Holland | 16/125 |
| 1,635,259 | 7/1927 | Critchley | 294/15 X |
| 1,689,170 | 10/1928 | Farmer | 294/78 R |
| 3,877,824 | 4/1975 | Jury | 403/174 |

*Primary Examiner*—Johnny D. Cherry

*Attorney, Agent, or Firm*—Warren, Chickering & Grunewald

[57] ABSTRACT

A mechanic's lifting device comprising a circular ring-shaped supporting member having an annular load-bearing wall dimensioned for engagement by a lifting hook or the like. A plurality of threaded studs are mounted on and extend radially outward from the wall for threading into an object to be lifted. The studs are positioned in circumferentially spaced relation on the wall. There are a plurality of hook engageable areas disposed in diametrically opposed relation to the studs with one such area diametrically opposed to each of the studs.

1 Claim, 2 Drawing Figures

MECHANIC'S LIFTING DEVICE

BACKGROUND OF THE INVENTION

1. Field of Invention

This invention relates to lifting and hoisting fittings used by mechanics.

2. Description of Prior Art

The lifting and hoisting of heavy objects by machinists and mechanics are often facilitated by the useof a lifting fitting which is screwed into a threaded receiving hole located on the object to be lifted. Lifting fittings are designed to provide a surface of suitable dimension and strength for engagement and subsequent hoisting by a lifting hook, chain, cable, or the like. The most common lifting fitting is the so-called lifting eye which consists of a metal ring having a single radially extending threaded stud. These lifting eyes are found in everyday use in machine shops, auto repair shops, and other repair and maintenance facilities which share the need for lifting and moving heavy mechanical objects.

Engine blocks, large electric generators, and other heavy mechanical objects frequently have threaded holes suitable for receiving the threaded stud of a lifting eye. It is generally found that the majority of the objects lifted have holes which are threaded in one of four or five common thread sizes. The mechanic must, therefore, have on hand an assortment of lifting eyes in order to fit the usual variety of mechanical objects which are encountered in his work.

Much time is wasted in selecting and fitting lifting eyes to objects. Often the eye of the proper size is lost or misplaced. Heavy-duty lifting eyes are frequently of sufficient size and weight to preclude a person from carrying more than one or two at a time. If the proper size thread is not chosen on the first try, the mechanic must go back to the toolbox to obtain an eye of the proper size. The necessity of selecting, in advance, a lifting eye of the proper thread size for connection to the object to be lifted wastes time and creates storage problems. Additionally, given the fact that a mechanic generally uses one eye at a time, it is wasteful to have a toolbox full of idle lifting eyes which differ from the one in use only in the thread size of the attached stud.

If a single lifting device could be fitted to objects having various sizes of threaded receptacles, then the delays, waste, and duplication attendant to storage, selection, and use of common lifting eyes would be eliminated. Accordingly, there is a need for a lifting device which can be fitted to a variety of threaded receptacles without impairing the ability of the device to receive a hook, chain, cable or other lifting means.

SUMMARY OF THE INVENTION

According to the present invention a circular ring-shaped supporting member is provided having an annular load-bearing wall dimensioned for engagement by a lifting hook or the like. the circular ring shape of the supporting member allows for easy insertion of a lifting hook. Additionally, the circular shape allows a load to shift while hanging, thus, providing optimal balancing qualities. With certain precautions and restrictions, this circular form provides an ideal common anchorage for a plurality of circumferentially spaced radially extending threaded studs which serve to attach the supporting member to the object to be lifted. The studs are positioned in circumferentially spaced relation so that a hook engageable area is disposed in diametrically opposed relation to each stud. This allows use of any one of the studs for work attachment since there will be an unimpaired section of the supporting member directly across from the stud which can be engaged by a hook or similar lifting means.

In the preferred embodiment of the invention, the supporting member is of a toroidal shape. A toroid provides all of the desirable qualities of a circular ring shape while providing maximum strength. In the preferred embodiment the studs are equally circumferentially spaced and have different thread sizes. It has been found that by providing an odd number of equally circumferentially spaced studs, an unimpaired hook engageable area will always be disposed in diametrically opposed relation in each stud.

The instant invention, when provided with studs having the thread sizes most commonly encountered, allows a mechanic to use a single fitting for most of his lifting needs. The studs, besides providing a variety of thread sizes, co-function, in their circumferential arrangement, to provide unimpaired hook engageable areas on the section of the toroid wall which is diametrically opposed to each stud. The present invention eliminates the necessity of stocking a large assortment of lifting eyes. By providing, for example, five different studs of the most common thread sizes on a single ring, the instant invention meets most of the daily needs of a mechanic. The present invention would offer substantial reductions in manufacturing cost, storage space, and time wastage attendant to common lifting eyes.

It, therefore, becomes the principal object of the present invention to provide a mechanic's lifting device which can be fitted to a variety of different threaded receptacles, yet still permit simple insertion and unimpaired engagement of a lifting hook or the like.

Another object of the present invention is to provide a lifting fitting which will substantially reduce the number of individual lifting fittings which must be stocked by a mechanic to fit objects most commonly lifted.

A further object of the present invention is to provide a versatile lifting fitting which can be manufactured at less cost than the individual common lifting eyes which it can replace.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 1:
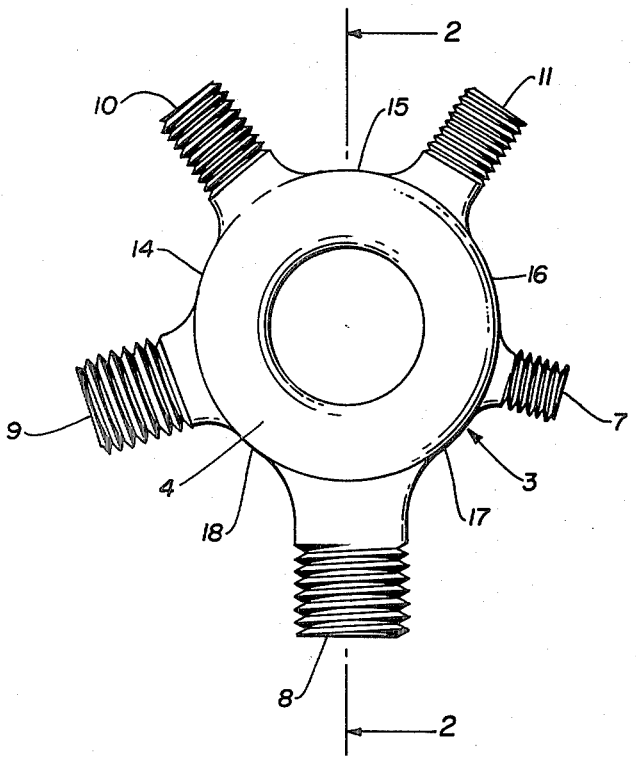
FIG. 1 is a front view of the preferred embodiment of the lifting device.
Figure 2:
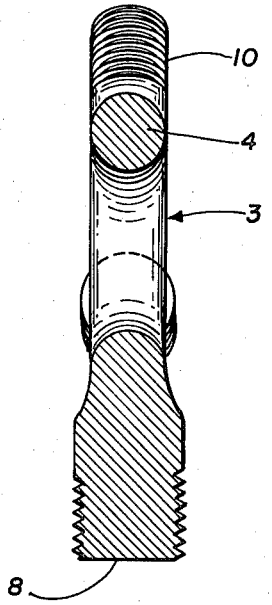
FIG. 2 is a cross section of FIG. 1, taken along the line 2—2.

As shown in FIG. 1, the lifting device of the present invention comprises a circular ring-shaped supporting member 3, having an annular load-bearing wall 4 dimensioned for engagement by a lifting hook or the like. A plurality of threaded studs 7, 8, 9, 10 and 11 are mounted on and extend radially outward from the wall 4 for threading into an object to be lifted. The studs 7–11 are of different thread sizes representing the sizes most commonly required in ordinary usage, e.g. ½ inch pipe NPT, ⅝-11, ½-13, ¼ pipe NPT, and ⅜-16. The studs 7–11 are positioned in circumferentially spaced relation on the wall 4. There are a plurality of hook engageable areas 14, 15, 16, 17 and 18 disposed in diametrically opposed relation to studs 7, 8, 9, 10 and 11, respectively. With reference to FIG. 1, it can be seen that each of the studs 7–11 in combination with the attached supporting member 3 comprises a lifting eyebolt so that the single structure illustrated will serve to replace five different common eyebolts.

As can be seen in FIG. 1, equal circumferential spacing of an odd number of studs (five in the preferred embodiment) places an unimpaired hook engageable area diametrically opposite each stud. Thus it can be seen that the structure of the present invention does not forfeit any of the advantages such as ease of hook insertion and engagement offered by common single-stud eyebolts.

As will be further observed, the annular toroid form of wall 4 provides a common equally distributed load-bearing ability for each of the studs.

What is claimed is:

1. A mechanic's lifting device comprising:

a toroidal-shaped supporting member having an annular load-bearing wall dimensioned for engagement by a lifting hook or the like;

an odd-numbered plurality of threaded studs of different sizes mounted on and extending radially outwardly from said wall for threading into an object to be lifted, said studs being positioned in equal circumferentially spaced relation on said wall and with a plurality of hookengageable areas disposed in diametrically opposed relation to said studs with one such area diametrically opposed to each of said studs.

* * * * *